United States Patent [19]

O'Keefe et al.

[11] 4,010,538

[45] Mar. 8, 1977

[54] PHONO PLUG

[75] Inventors: Michael Francis O'Keefe, Mechanicsburg; Dennis Penrose Schwenk, Hummelstown; Ronald Clair Laudig, Mechanicsburg; Suel Grant Shannon, Harrisburg, all of Pa.

[73] Assignee: AMP Incorporated, Harrisburg, Pa.

[22] Filed: Apr. 26, 1976

[21] Appl. No.: 680,612

Related U.S. Application Data

[62] Division of Ser. No. 592,160, July 1, 1975, abandoned.

[52] U.S. Cl. ..... 29/630 A; 29/628; 29/629; 339/177 E; 339/183

[51] Int. Cl.² ..... H01R 9/00

[58] Field of Search ..... 29/628, 629, 630 R, 29/630 A; 339/276 R, 276 T, 177 R, 177 E, 223 S, 223 R, 217, 258, 221, 183

[56] References Cited

UNITED STATES PATENTS

| | | | |
|---|---|---|---|
| 3,295,094 | 12/1966 | DeLyon et al. | 339/276 T X |
| 3,670,293 | 6/1972 | Garver | 339/276 T X |
| 3,715,708 | 2/1973 | Lloyd et al. | 339/177 E |
| 3,723,949 | 3/1973 | Wallo | 339/177 R |
| 3,793,616 | 2/1974 | Moehrke | 339/223 S |
| 3,824,528 | 7/1974 | Esser | 339/177 R X |

*Primary Examiner*—James R. Duzan
*Attorney, Agent, or Firm*—Allan B. Osborne

[57] ABSTRACT

This invention relates to a phono plug and a method of making it. An insulated disc through which extends a center contact member terminated to a center conductor of a coaxial cable is positioned in the inside surface of a U-shaped outer shell member and enclosed therein by closing the shell member into a generally cylindrical housing. An open barrel integrally attached to the shell member is either simultaneously or subsequently crimped around the braided shield on the coaxial cable to complete the phono plug.

2 Claims, 5 Drawing Figures

PHONO PLUG

This is a division of application Ser. No. 592,160, filed July 1, 1975, now abandoned.

BACKGROUND OF THE INVENTION

Phono plugs of the type concerned with herein contain an electrically conductive center contact pin carried by a washer or disc of insulating material mounted within an electrically conductive shell member. The center contact pin is adapted to be plugged into an aperture-containing jack about which the shell member engages frictionally.

Prior art phono plugs generally have shell members which are made by drawing and shaping a piece of seamless tubing or the like. An insulating washer or disc through which extends the center contact pin is placed within the shell member and retained therein by internal annular shoulders which are biased against the disc by longitudinally squeezing or shortening the shell member, by indentations in the shell member at spaced intervals gripping the disc, by bent over lugs, or by a combination of the above. The coaxial cable is, generally attached to the center contact pin and shell member by soldering. Two such prior art phono plugs are disclosed in U.S. Pat. No. 3,723,949 and No. 3,295,094.

As is known to those skilled in the art, the currently used phono plugs including those described briefly above, while generally satisfactory in performance, involve complicated, excessive manufacturing steps, which do not lend themselves well to automatic assembly thereof and further are expensive to make.

Another problem associated with prior art phono plugs is that of strength and more particularly strength of the phono plug shell under forces exerted by the attached wires being flexed or bent.

Still another problem with phono plugs related to RF leakage through openings in the shell.

Accordingly, an important object of the present invention is to provide a phono plug which is inexpensive to make and can be mass produced on automatic machines.

Another object of the present invention is to attain important advantages and improvements in the structure and method of making phono plugs.

Still another object of the present invention is to provide a new and improved phono plug in which the components thereof are stamped and formed from planar sheets of conductive material and which contain thereon means to crimp such components onto the coaxial cable.

Yet another object of the present invention is to provide a phono plug having a stronger outer member or shell which resists the blending of wire transverse to the axis of the plug.

Still another object of the present invention is to provide a phono plug having reduced RF leakage therefrom.

Other objects, features and advantages of the invention will be readily apparent from the following description of the preferred embodiments thereof, taken in conjunction with the accompanying drawings, although variations and modifications may be effected without departing from the spirit and scope of the novel concepts embodied in the disclosure and claims.

DESCRIPTION OF THE PREFERRED EMBODIMENT

Figure 1:
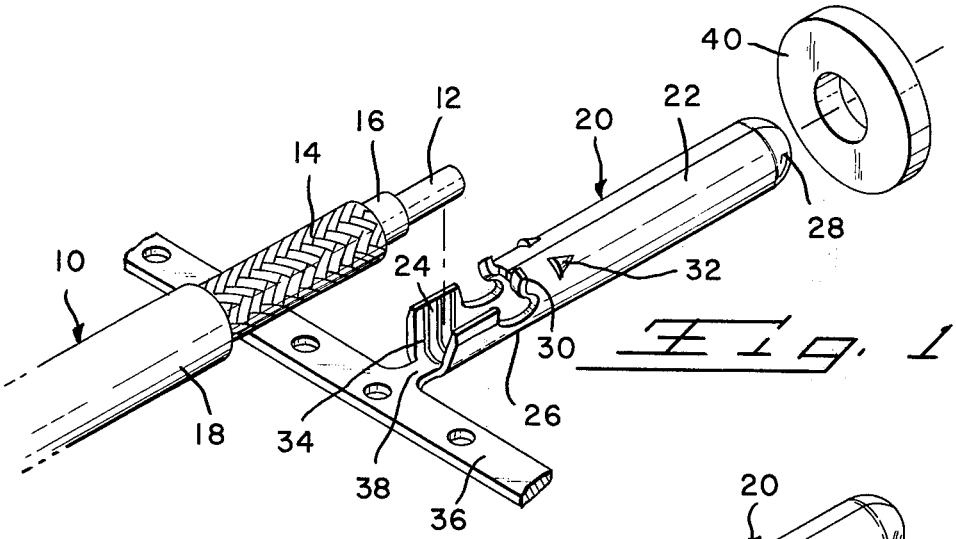
FIGS. 1 through 4 are perspective views illustrating the components and assembly of the preferred embodiment of the present invention.

With reference to FIG. 1, coaxial cable 10 which is terminated to the phono plug of the present invention consists of a center conductor 12, a braided metal shield 14 and a dielectric 16 positioned thereinbetween. Surrounding shield 14 is the outer insulating jacket 18.

The center contact member 20 is shown in FIG. 1 to the right cable 10. The stamped and formed inner or center contact member, shown in the assembling stage, consists of a cylindrical center pin 22, a center conductor open wire barrel 24 and an integral connecting strap 26 thereinbetween.

The cylindrical center pin 22 includes a front and or nose 28 which is rounded to facilitate pushing the phono plug into a jack (not shown) such as are on an amplifier or other like device.

At the opposite end of the center pin at least two spaced apart tabs 30 project outwardly normal to the longitudinal axis of the center pin. These tabs are integral with the center pin, being simply stamped out from a roll of sheet metal (not shown) from which the center pin member 20 is stamped and formed.

A number of spaced apart dimples 32 positioned around the circumference of center pin 22 are located just forward of the aforementioned tab 30. Like the tabs, dimples 32 are stamped out from the material comprising the center pin.

Center conductor barrel 24 is stamped into a U-shape which can be crimped into complete encompassing engagement with center conductor 12. Grooves 34 are provided on the inside surface of the barrel 24 to enhance the electrical contact characteristics as well as to provide a mechanical gripping.

FIG. 1 shows the center contact member in an assembling stage. That is, a carrier strip 36, connected to the back end of barrel 24 by a connecting strap 38, is stamped and formed from the same roll of sheet metal and simultaneously as is the center contact member 20. The carrier strip, having spaced holes therealong, permits the attached center contact member to be fed through automatic assembling machines (not shown) whereby barrel 24 is crimped around center conductor 12.

Also shown in FIG. 1 is the second of four components; e.g., a round disc 40 made of somewhat rigid, insulating material such as phenolic. The dimension of its center hole 42 is the same as the outer diameter of center pin 22 on which the disc is positioned (see FIG. 2). The disc width equals the distance or interval between the aforementioned tabs 30 and dimples 32, these two features comprising locating and retaining means on the center pin 22 for the disc 40.

Figure 2:
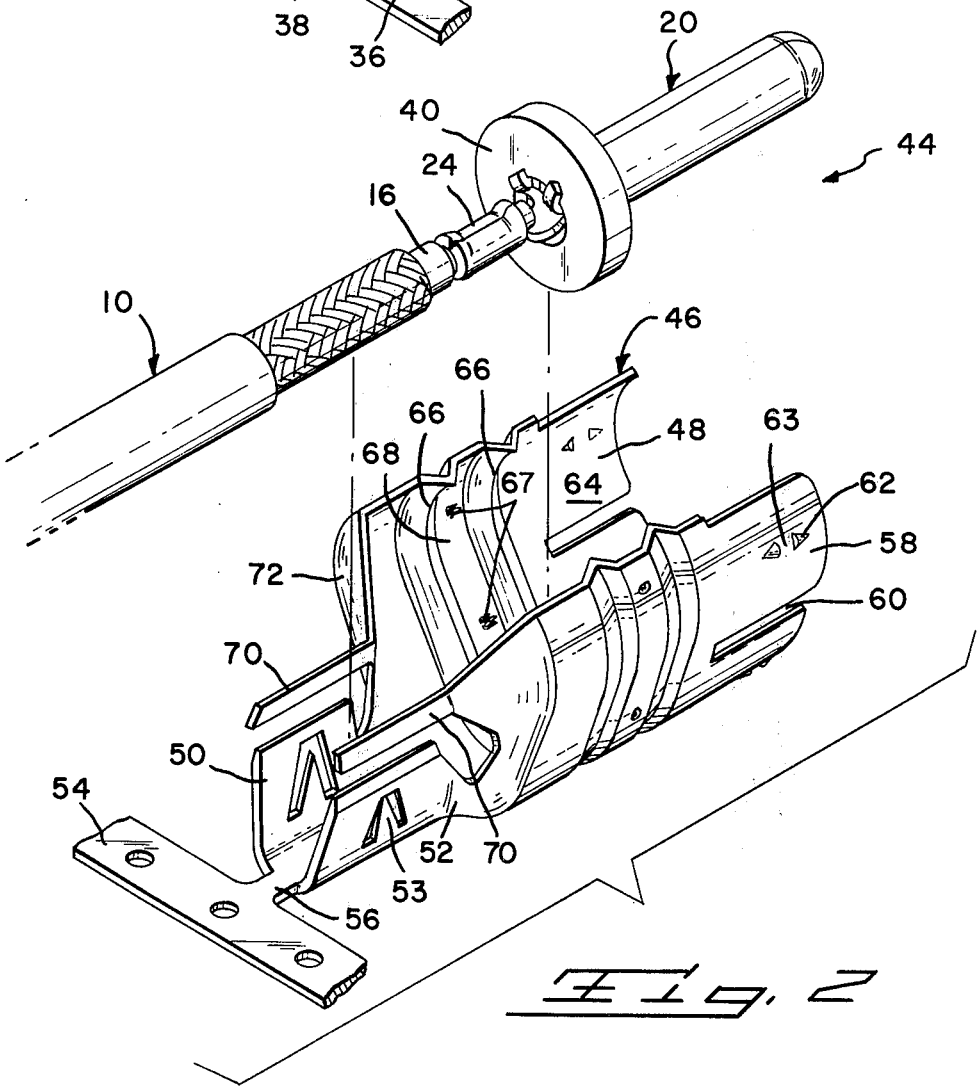

FIG. 2 shows that what is hereinafter referred to as the phono plug subassembly 44, such being the center contact member 20, barrel 24 being crimped around center conductor 12, and disc 40 positioned on center pin 22 between the retaining means (tabs 30 and dimples 32). Note that carrier strip 36 and connecting strap 38 (FIG. 1), having served their usefulness, have been cut away from center contact member 20. Also note that the back end of barrel 24 abutts dielectric 16 on cable 10.

The third component of the phono plug is the outer contact means or shell member 46, seen below subassembly 44 in FIG. 3.

Shell member 46 consists of a housing 48 and a braided shield open wire barrel 50 which is integral with housing 48, being joined thereto by connecting strap 52. A pair of lances 53 are provided within barrel 50. As the shell member 46 is shown in the assembling stage, a carrier strip 54, connected to the back of barrel 50 by a strap 56, is also shown. As with center contact member 20, the carrier strip having spaced holes as the means by which shell member 46 is fed from a reel (not shown) into an automatic assembling machine (also not shown).

Housing 48 has a width such that its inside circumference when it is closed (see FIG. 4) is equal to the circumference of disc 40. The several distinct features of housing 48 includes a skirt 58 positioned on the front end of the housing. The skirt contains a number of slots 60 extending rearwardly from the front end and are spaced at equal intervals along the length or around what will become the circumference of the skirt after final assembly of the phono plug. Pairs of spaced tines 62 positioned about the outer circumference of skirt 58 define a trace 63 and provide a retention ring retaining means.

Intermediate the two ends of housing 48 and on its inside surface 64 are a pair of spaced-apart ribs 66 which define a disc-receiving groove 68. As is apparent from the drawings, the width of the groove is about equal to the thickness of insulating disc 40. These two ribs provide locating and retaining means for positioning subassembly 44 into shell member 48. As is well known in the art of stamping and forming, ribs 66 may be coined into the metal. Inward projecting lances 67 may be provided to bear into the disc and prevent rotational movement.

A pair of fingers 70 extend rearwardly from the rear edge 72 of housing 46.

Figure 3:
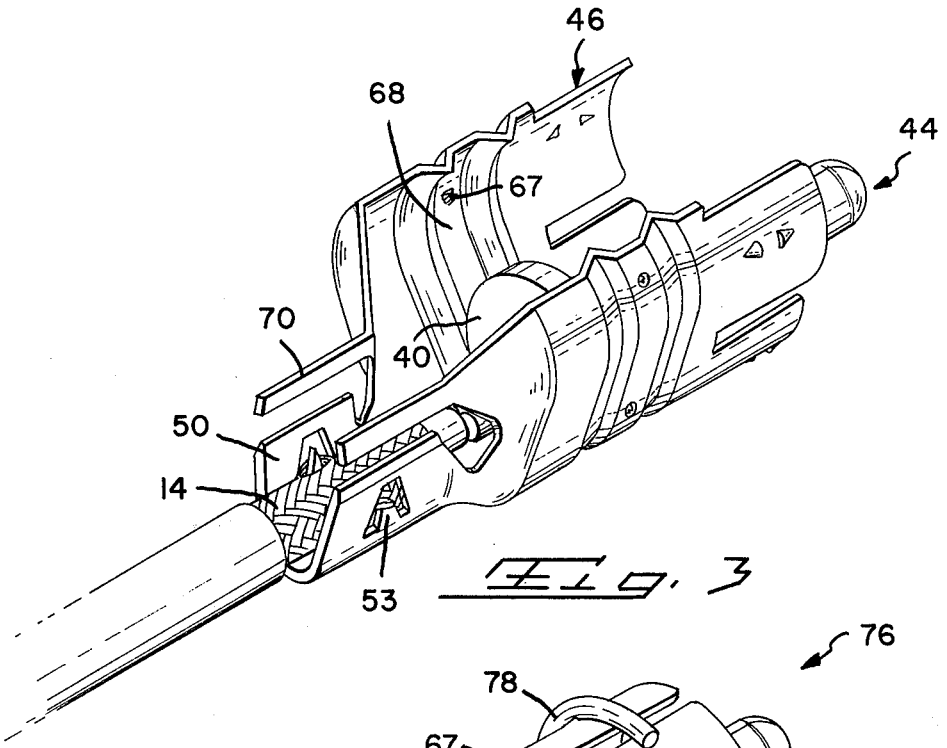

In FIG. 3, subassembly 44 has been laid into the open shell member 46 with disc 40 positioned in groove 68. Further, lances 53 in barrel 50 have pierced through the braided shield 14 so that a portion thereof is in effect "weaved" into the barrel.

Figure 4:
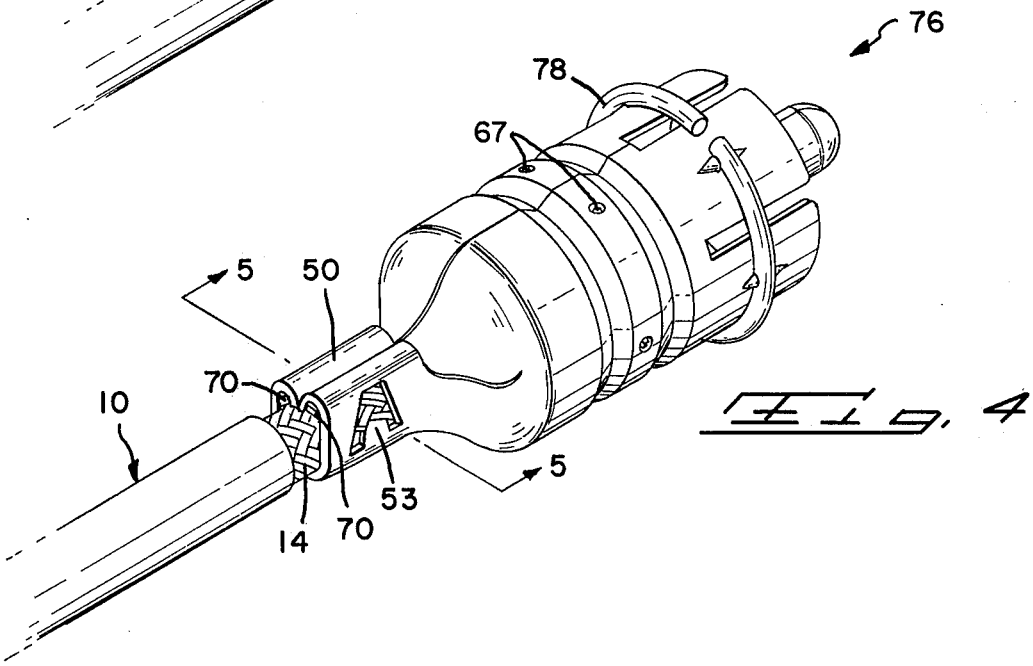

FIG. 4 illustrates a completed phono plug assembly 76.

Housing 48 has been formed or crimped around disc 40 and a retention ring 78 slipped around skirt 48 into trace 63 between tines 62. Retention ring 78 describing something less than a complete circle provides inwardly biasing means against outward expansion of skirt 58 as the phono plug is pushed onto a jack (not shown). Further, the ring increases the frictional forces of the plug against the jack so that accidental or vibrational disconnects are minimized.

As the housing is being wrapped around disc 40, rearwardly projecting fingers 70 are being laid down into open barrel 50. Then, as barrel 50 is crimped around, the fingers are trapped within. This results in a much stronger phono plug and further, the edge 72 closes the back end of the housing what otherwise would be a sizable opening and a source of RF leakage.

Figure 5:
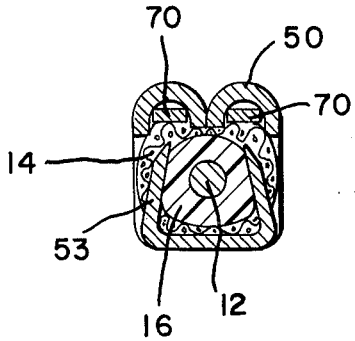
FIG. 5 is a cross-sectional view taken along the lines 5—5 of FIG. 4.

FIG. 5 is a cross-sectional view showing the trapping of finger 70 as described above. This view also shows how the fingers maintain electrical symmetry.

The material preferably used in fabricating the conductive shell member 46 and contact member 20 is steel with a tin plated finish. The disc 40 is preferably made from polyvinyl chloride (PVC). Ring 78 is made from tin plated spring wire.

As aluded to above, the contact and shell members may be stamped and formed from flat metal stock. The disc can be stamped out from sheets of PVC.

A method of assembling phono plug 76 is illustrated in FIGS. 1 through 4. In FIG. 1, the stripping of cable 10 to expose center conductor 12 and braided shield 14 has already been accomplished. Also the center contact member 20 has been formed from flat stock (not shown) into the elongated tubular form shown. Disc 40 is slipped onto the contact member 20 and into the groove defined by tabs 30 and dimples 32 32. conductor 12 is laid into the open wire barrel 24 and the sides thereof crimped into an encompassing relation thereto. These two operations provide the subassembly 44 with cable 10 attached seen in FIG. 2.

With reference to FIG. 3, the subassembly is placed into the opened shell member 46 with disc 40 being received within groove 68. Simultaneously the exposed braided shield 14 is placed into open barrel 50 so that lances 53 therein pierce through the shield as shown. Shell member 46 is closed around disc 40 and wire barrel 50 crimped around the cable in the area of the exposed braided shield. Ring 78 is slipped over the now closed shell member 46 and inbetween the pairs of tines 62. FIG. 4 shows the assembled plug.

The foregoing detailed description has been given for clearness of understanding only, and no unnecessary limitations should be understood therefrom, as some modifications will be obvious to those skilled in the art.

What is claimed is:

1. A method of asembling a phono plug comprising the steps of:

a. stripping a length of coaxial cable to expose the center conductor and the braided shield;

b. providing a center contact member having a pin at one end and a wire barrel at another end and crimping the wire barrel around the exposed length of the center conductor;

c. slipping an annular insulating disc around the pin on the center contact member;

d. providing a shell member having an open housing portion at the forward end with a pair of fingers projecting rearwardly therefrom, and an open wire barrel at the rearward end and placing the disc carrying center contact member into the open housing portion so that the exposed braided shield lies in the open wire barrel;

e. forming the open housing portion into a closed cylinder around the insulating disc with the fingers on the housing being placed into the open wire barrel; and f. crimping the wire barrel on the shell member into encompassing relation about the fingers and the braided shield lying therein.

2. The method of claim 1 further including the step of placing a resilient retaining ring around the closed housing.

* * * * *